US005293800A

United States Patent [19]

Nunn, Jr.

[11] Patent Number: 5,293,800

[45] Date of Patent: Mar. 15, 1994

[54] WORKPIECE MANIPULATING DEVICE

[76] Inventor: Woodrow W. Nunn, Jr., 15521 Vine Ave., Harvey, Ill. 60426-4324

[21] Appl. No.: 987,582

[22] Filed: Dec. 8, 1992

Related U.S. Application Data

[63] Continuation of Ser. No. 856,406, Mar. 23, 1992, abandoned.

[51] Int. Cl.[5] ..... B27B 5/29

[52] U.S. Cl. ..... 83/437; 83/435.1; 144/242 R

[58] Field of Search ..... 83/437, 435.1, 477.2; 7/164; 144/251 R, 242 R, 245 R, 245 E; D8/14

[56] References Cited

U.S. PATENT DOCUMENTS

| | | | |
|---|---|---|---|
| D. 278,022 | 3/1985 | Ash | D8/14 |
| D. 278,790 | 5/1985 | Chaney et al. | D8/14 |
| 2,410,467 | 11/1946 | Valentine | 83/437 |
| 2,839,100 | 6/1958 | Valicenti | 7/164 X |
| 3,138,180 | 6/1964 | Schultz | 83/437 X |
| 4,001,903 | 1/1977 | Hay | 7/164 |
| 4,282,615 | 8/1981 | Tom | 7/164 |
| 4,348,925 | 9/1982 | Manweiler | 83/437 X |
| 4,370,909 | 2/1983 | Jennings | 144/242 R X |
| 4,603,612 | 8/1966 | Atkins | 83/435.1 X |
| 4,658,686 | 4/1987 | Woods | 83/437 X |
| 5,016,509 | 5/1991 | Stottman | 83/437 |

*Primary Examiner*—Rinaldi I. Rada

*Attorney, Agent, or Firm*—Trexler, Bushnell, Giangiorgi & Blackstone, Ltd.

[57] ABSTRACT

There is disclosed a workpiece manipulating device for use in manual control of workpieces being fed directly into and beyond workpiece altering mechanisms that are driven by table mounted or bench mounted power tools. The device generally includes a piece of flat stock having two pressure points that provide a positive contact with the workpiece in order to enable manual control of the direction of the workpiece. The device also includes a handle that places the operator's hand and fingers in a remote location from the workpiece altering mechanism.

3 Claims, 1 Drawing Sheet

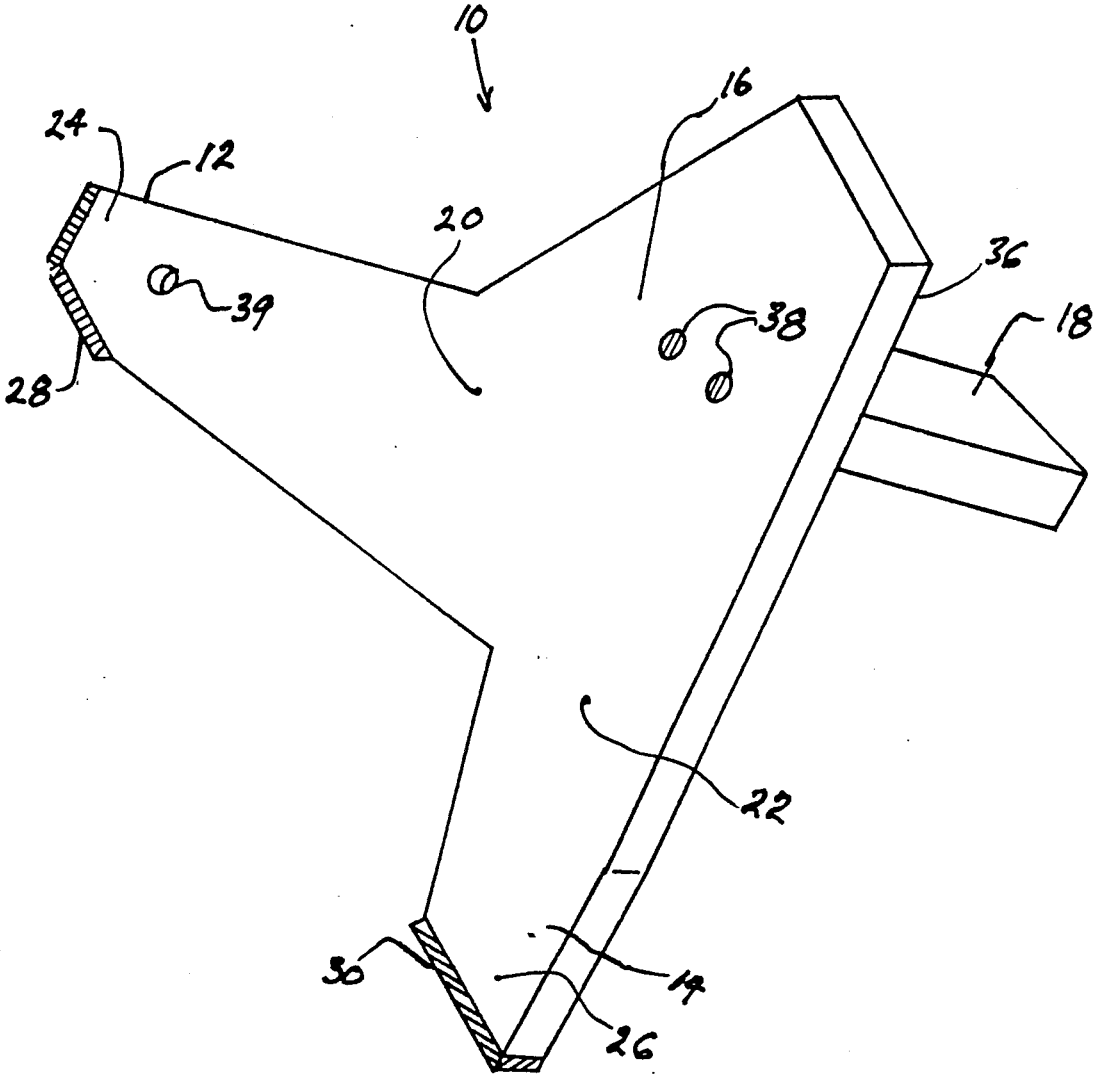
10
16
24
12
20
36
39
38
18
28
22
30
14
26

WORKPIECE MANIPULATING DEVICE

This application is a continuation of application Ser. No. 07/856,406, filed Mar. 23, 1992, now abandoned.

FIELD OF THE INVENTION

The present invention relates to safety devices for use in conjunction with operating a table mounted or bench mounted power saw or power router, and is specifically concerned with workpiece manipulating devices designed to facilitate manual control of workpieces and maintain the operator's fingers and hand safely distant from any table or bench mounted power tool operation hazard.

The operating hazard of a table or bench mounted power saw or power router, or any other table or bench mounted power tool, generally involves manual control and feed of a workpiece into the workpiece altering mechanism of the power tool. The operating hazard of any power tool is the inherent threat of severe and permanent injury to the fingers and hand if accidentally brought into contact with the workpiece altering mechanism while directly manipulating control of a workpiece. If direct manipulation control is insufficient, two situations can occur; one of which is complete loss of control whereby the workpiece can momentarily jam, and then instantaneously and forcefully be propelled back toward the operator, or else the workpiece is damaged with an undesirable alteration and possibly damages the workpiece altering mechanism. The second situation is partial loss of control, whereby the workpiece is partially being manipulated by the rotating forces of the workpiece altering mechanism, and when the operator attempts to re-establish direct manipulation control, the fingers and hand can be accidentally brought into contact with the workpiece altering mechanism and cause severe and permanent injury. In accordance with the present invention the operating hazard of inherent threat of severe or permanent injury to the operator's fingers and hand is completely removed.

In order to eliminate this problem, some prior art devices suggest using a second pusher in conjunction with a first pusher. This requires the use of both hands which can make the operator highly vulnerable to the hazards of certain table or bench mounted power tools. Specifically, the use of both hands to manipulate a workpiece into a table mounted power saw can bring the operator's upper body proximally over the rotating workpiece altering mechanism without adequate support of the operator's upper body. This invention provides a device that does not require the operator to use both hands thereby eliminating this problem.

Other prior art workpiece manipulating devices use a two pronged tip that is intended to make purchase into the material of the workpiece in order to facilitate manipulation. These prior art devices, however, are undesirable in certain conditions. If a workpiece is in an advanced state of finish, these devices can mar, scratch or otherwise render the workpiece unsuitable or unusable which occurs as a direct result of the two pronged tip making purchase into the material. The present invention is intended to overcome this problem.

OBJECTS OF THE INVENTION

It is a principal object of the invention to be a novel workpiece manipulating device.

It is another object of the invention to be a workpiece manipulating device which extends the operator's reach of manual control of workpieces with no loss of efficacy.

It is yet another object of the invention to be a workpiece manipulating device with improved controllability of workpiece manipulation.

It is yet another object of the invention to be a workpiece manipulating device adaptable for use on workpieces of different thicknesses and widths.

Other objects and advantages of the present invention will in part be obvious and will in part appear hereinafter.

GENERAL DESCRIPTION OF THE INVENTION

The workpiece manipulating device of the invention broadly comprises a piece of flat stock in the shape of a silhouetted hand indicating the thumb and forefingers being extended apart, a handle attached perpendicular to the plane of the flat piece of stock and resembling a hand being held perpendicular to the forearm. The terminals represented by the thumb and forefinger shapes have pieces of soft rubber permanently attached thereto providing the control gripping for manipulating the workpiece.

THE DRAWING(S)

A better understanding of the structure and function of the present invention can be had by referring to the drawing forming part hereof, wherein; the drawing is a schematic, diagrammatic perspective view of all embodiments of the workpiece manipulating device of this invention.

DESCRIPTION OF PREFERRED EMBODIMENTS

In the present invention, a workpiece manipulating device 10 is used for manually guiding a workpiece (not shown) as it is being fed directly into and beyond a conventional rotating workpiece altering mechanism (not shown). The workpiece manipulating device 10 may be used with a table mounted or bench mounted power saw or power router, or any other table mounted or bench mounted tool. The workpiece manipulating device 10 may be used with workpieces of difference thicknesses and widths while still allowing the operator to manipulate the position of the workpiece.

A rotating workpiece altering mechanism exerts two forces on a workpiece as the workpiece passes through the mechanism. On a horizontal plane, such as a table top, there is a downward cutting force exerted on a workpiece as it is fed into and toward the center of the rotating cutting-edge. A lifting and throwing force is exerted on a workpiece as it is fed beyond and away from the center of the cutting-edge. This occurs because of a lack of downward pressure on the workpiece as it is fed beyond the center of the cutting-edge. Therefore, the workpiece can be lifted up intermittently which can cause a chattering noise. The workpiece can also shift laterally during the lifting and throwing motion which can cause the workpiece to be violently thrown back toward the operator.

In order to solve this problems, the workpiece manipulating device 10 uses two portions 12 and 14 for providing dual horizontal and lateral control simultaneously as the workpiece is being fed into and beyond a rotating workpiece altering mechanism. As shown in the figure, the workpiece manipulating device 10 is generally comprised of a single shaped piece of stock material having a body 16, a forwardly and downwardly extending portion 12 and a rearwardly and downwardly extending portion 14. Also included in the workpiece manipulating device 10 is a handle 18 that is attached to the body 16. As can be seen from the figure, the workpiece manipulating device 10 generally imitates the shape of a human hand wherein the forwardly and downwardly extending portion 12 is the forefingers and the rearwardly and downwardly extending portion 14 is the thumb.

The body 16 is in a generally vertical upstanding position. Each portion 12 and 14 has a first end 20 and 22 that is part of the body 16 and a second end 24 and 26 that extends outwardly and downwardly from the body 16. Each of the second ends 24 and 26 extends in opposite directions from the body 16. The portions 12 and 14 and the body 16 are of a rigid construction and made of a rigid material, such as a laminated or solid wood, metal or may be made of a rigid acrylonitrile-butandiene-styrene polymer composition. The portions 12 and 14 and the body 16 are relatively flat. The forwardly extending portion 12 and the rearwardly extending portion 14 are arranged so that the portions 12 and 14 are at a distance apart in order to provide manipulating control by the operator. This arrangement will provide a positive feed control of the workpiece as it passes into and beyond the workpiece altering mechanism.

Each portion 12 and 14 has a discrete terminus 28 and 30 on its outermost point that is used to contact and grip the workpiece. Thus, the terminuses 28 and 30 are located at a distance apart from each other. The terminuses 28 and 30 of the portions 12 and 14 provide two pressure points that contact the workpiece as it is being fed through the altering mechanism by the operator. The body 16 is shaped between the terminuses 28 and 30 such that the body 16 does not contact the workpiece.

Attached to the terminus 28 and 30 of each portion 12 and 14 is a gripping means 32 and 34, such as a piece of soft rubber or the like, for holding the workpiece under the workpiece manipulating device 10. The gripping means 32 and 34 are attached by suitable means so as to be permanently attached. The gripping means 32 and 34 contact the workpiece at the pressure points. When rubber is used as the material in the gripping means 32 and 34, the workpiece will not slide out from under the workpiece manipulating device 10 since the characteristics of the rubber provides a surface that will effectively grip the workpiece. Furthermore, when rubber is used, the workpiece manipulating device 10 will not damage the finish since the characteristics of the rubber provides a soft surface for the contact points.

Also provided with the present invention is a handle 18 that extends laterally from a side 36 of the body 16 at a location between the terminuses 28 and 30. In the preferred embodiment, the handle 18 takes on a rectangularly flat shape and projects perpendicularly from the side 36 of the body 16. The handle 18 is rigid in construction and may be made of suitable materials such as wood or metal. The handle 18 is attached to the body by a suitable fastener 38 in a manner such that it may be detached from one side of the body 18 and re-attached to the other side of the body 18.

The handle 18 extends outwardly from the side 36 of the body 18 on the opposite side from the workpiece altering mechanism in order to place the operator's hand and fingers safely away or remote from the rotating workpiece altering mechanism and the workpiece itself. The body 16 will serve to shield the operator's hand and fingers since the handle 18 is on the opposite side of the body 18 from the rotating workpiece altering mechanism. Therefore, the hazard of the operator's fingers and hand being accidentally brought into contact with the workpiece altering mechanism is eliminated. Furthermore, the operator only needs to use one hand to operate the workpiece manipulating device 10 while extending the operator's reach without any compromise in physical stability and safety.

Another feature of the present invention is an aperture 39 near the terminus 28 of the forwardly extending portion 12. This aperture 39 will accommodate a detached hanging apparatus, such as a hook in order to store the device 10.

While a preferred embodiment of the present invention is shown and described, it is envisioned that those skilled in that art may devise various modifications of the present invention without departing from the spirit and scope of the appended claims. The invention is not intended to be limited by the foregoing disclosure.

I claim:

1. A workpiece manipulating device for use with a rotating workpiece altering mechanism in order to allow an operator to manually control the direction of the workpiece during alteration, said workpiece manipulating device comprising:

an upstanding planar body;

said body including a forwardly and downwardly extending front end portion coplanar with said body;

said forwardly and downwardly extending front end portion having a discrete terminus that provides a contact point with said workpiece;

said body including a rearwardly and downwardly extending rear end portion coplanar with said body;

said rearwardly and downwardly extending rear end portion having a discrete terminus that provides a contact point with said workpiece;

said rearwardly and downwardly extending rear end portion being spaced from said forwardly and downwardly extending front end portion;

said body having a ratched portion between said terminuses wherein said notched portion does not contact the workpiece, and a handle projecting laterally generally perpendicularly from a planar side of said body at a location between said terminuses such that an operator's hand and fingers engaging said handle are remote and shielded by said body from the rotating workpiece altering mechanism.

2. A workpiece manipulating device as defined in claim 1 wherein said terminuses include a gripping means attached thereto for contacting the workpiece.

3. A workpiece manipulating device as defined in claim 2 wherein said gripping means is permanently attached to the terminuses and made of a rubber material.

* * * * *

UNITED STATES PATENT AND TRADEMARK OFFICE

CERTIFICATE OF CORRECTION

PATENT NO. : 5,293,800

DATED : March 15, 1994

INVENTOR(S) : Woodrow W. Nunn, Jr.

It is certified that error appears in the above-indentified patent and that said Letters Patent is hereby corrected as shown below:

Column 2, Line 45 "difference" should read — different —

Column 22, Line 63 "problems" should read — problem —

Column 4, Line 49 "ratched" should read — notched —

Signed and Sealed this

Thirtieth Day of August, 1994

*Attest:*

*Attesting Officer*

Bruce Lehman

BRUCE LEHMAN

*Commissioner of Patents and Trademarks*